US011345184B2

(12) United States Patent
Harnois et al.

(10) Patent No.: US 11,345,184 B2
(45) Date of Patent: May 31, 2022

(54) SOLVENT TRANSFER PRINTING METHOD

(71) Applicants: CENTRE NATIONAL DE LA RECHERCHE SCIENTIFIQUE—CNRS –, Paris (FR); UNIVERSITE DE RENNES 1, Rennes (FR)

(72) Inventors: Maxime Harnois, Rennes (FR); Jacques Emmanuel, Rennes (FR); Brice Le Borgne, Le Mans (FR)

(73) Assignees: CENTRE NATIONAL DE LA RECHERCHE SCIENTIFIQUE—CNRS, Paris (FR); UNIVERSITE DE RENNES 1, Rennes (FR)

( * ) Notice: Subject to any disclaimer, the term of this patent is extended or adjusted under 35 U.S.C. 154(b) by 243 days.

(21) Appl. No.: 16/480,465

(22) PCT Filed: Jan. 26, 2018

(86) PCT No.: PCT/EP2018/051997
§ 371 (c)(1),
(2) Date: Jul. 24, 2019

(87) PCT Pub. No.: WO2018/138283
PCT Pub. Date: Aug. 2, 2018

(65) Prior Publication Data

US 2019/0351696 A1 Nov. 21, 2019

(30) Foreign Application Priority Data

Jan. 26, 2017 (EP) ..... 17305086

(51) Int. Cl.
*B44C 1/175* (2006.01)
*B41F 7/02* (2006.01)

(52) U.S. Cl.
CPC ..... *B44C 1/175* (2013.01); *B41F 7/02* (2013.01)

(58) Field of Classification Search
None
See application file for complete search history.

(56) References Cited

U.S. PATENT DOCUMENTS 4,010,057 A 3/1977 Nakanishi
4,269,650 A * 5/1981 Arai ..... B41M 5/025 101/153

(Continued)

FOREIGN PATENT DOCUMENTS

EP 3042784 A1 7/2016
JP H11-179279 A 7/1999

(Continued)

OTHER PUBLICATIONS

International Search Report dated Aug. 10, 2018 in corresponding International Application No. PCT/EP2018/051997; 7 pages.

(Continued)

*Primary Examiner* — Joshua D Zimmerman
(74) *Attorney, Agent, or Firm* — Maier & Maier, PLLC

(57) ABSTRACT

A solvent transfer printing method for applying a pattern made of a non-soluble material and non-dispersible on the surface of an object. The method includes the steps of: m1/forming a pattern on a surface of a solvent-soluble substrate, m2/depositing the solvent-soluble substrate on the surface of a solvent bath, on the side of the substrate opposed to the side on which the pattern is applied, in order to dissolve partially the substrate, m3/dipping the object in the bath, so that the surface of the object comes into contact with the pattern, m4/getting the object, on which the pattern is applied, out of the bath, and b 5/drying the object.

13 Claims, 9 Drawing Sheets

(56) References Cited

U.S. PATENT DOCUMENTS

| | | | |
|---|---|---|---|
| 2003/0007053 | A1 | 1/2003 | Bowles et al. |
| 2013/0041235 | A1 | 2/2013 | Rogers et al. |
| 2016/0059621 | A1 | 3/2016 | Szumski et al. |

FOREIGN PATENT DOCUMENTS

| | | | |
|---|---|---|---|
| JP | 2001-328398 | A | 11/2001 |
| JP | 2006-026933 | A | 2/2006 |
| WO | 2016088702 | A1 | 9/2016 |

OTHER PUBLICATIONS

Anonymous: "Hydrographics (printing)—Wikipedia (version of Sep. 26, 2016)", Retrieved from the Internet: URL: https://en.wikipedia.org/w/index.php?title=Hydrographics_(printing)&oldid=741298992; Retrieved on Jul. 6, 2017; 3 pages.

Anonymous: "Lift-off (microtechnology)—Wikipedia", Dec. 27, 2016, Retrieved from the Internet: URL:https://en.wikipedia.org/wiki/lift-off(microtechnology), Retrieved on Aug. 2, 2018; 3 pages.

Hickman: "Lift-off Photoresist Processing—CNS Standard Operating Procedure SOP112", Jul. 26, 2011, pp. 1-10, Retrieved from the Internet: URL:https://wcam.engr.wisc.edu/Public/Reference/Lithography/Harvard%20CNS%20liftoff%20and%20bilayer%20process.pdf, Retrieved on Aug. 2, 2018; 10 pages.

Anonymous: "SU-8 photoresist—Wikipedia", Sep. 7, 2016, Retrieved from the Internet: URL:https://en.wikipedia.org/w/index.php?title=SU-8_photoresist%oldid=738196305, Retrieved on Aug. 2, 2018; 4 pages.

Anonymous: "Material Safety Data Sheet—SU-8 developer", Jun. 26, 2001, Retrieved from the Internet: URL:http://www.princeton.edu/prism/mnfl/current-users/safety/msds/SU_8%20developer.pdf, Retrieved on Aug. 2, 2018; 4 pages.

* cited by examiner

SOLVENT TRANSFER PRINTING METHOD

FIELD

The instant invention relates to method for solvent transferring a pattern made of non-soluble and non-dispersible material on an object.

BACKGROUND

In particular, the instant invention is related to a solvent transfer printing method for conformably applying a pattern made of a non-soluble and non-dispersible material on the surface of an object.

In term of application, there is a growing interest for medical devices, epidermal electronics, curvilinear electro-optics, wearable electronics, conformal display, conformal photovoltaic system.

A known method in the prior art, described in the patent US20130041235, is a method for wrapping a pattern over a three-dimensional object consisting in wetting the surface of the object and sticking the surface of the substrate opposed to the side carrying the pattern on the object. However, due to the rigidity of the substrate, when the object has an irregular shape (angular, curvilinear . . . ), the pattern carried by the substrate pleats or breaks, in particular, when the pattern to report is spatially extended and/or when the object is angular.

SUMMARY

A first object of the invention is a solvent transfer printing method for applying a pattern made of a non-soluble and non-dispersible material on the surface of an object, said method comprises the following steps:

m1/forming a pattern on a surface of a solvent-soluble substrate, m2/depositing the solvent-soluble substrate on the surface of a solvent bath, on the side of the substrate opposed to the side on which the pattern is applied, in order to dissolve partially the substrate, m3/dipping the object in the bath, so that the surface of the object comes into contact with the pattern, m4/getting the object, on which the pattern is applied, out of the bath, and m5/drying the object.

A second object of the invention is a method for forming a pattern on a surface of a solvent-soluble substrate by combining a lithography process with a lift off process. according to the following steps:

a1/spin coating a photo-sensitive resist stack layer (4) on the solvent soluble substrate (3), a2/insulating the resist stack layer (4) through a mask, a3/developing the resist stack layer (4), with a first product which is solvent free, a4/depositing the pattern material (10) on the resist stack layer (4), a5/removing the resist stack-layer (4) with a second product which is also solvent free, in order to obtain the pattern formed.

A third object of the invention is the product obtained by the method described above for applying a pattern on an object.

A fourth object of the invention is the use of a solvent-soluble substrate on which is formed a pattern obtained by the method described above for forming a pattern.

BRIEF DESCRIPTION OF THE DRAWINGS

On the drawings:

FIG. 5*c* is a photography of an object on which a pattern has been transferred according to the method illustrated on FIGS. 5*a* and 5*b;*

On the different figures, the same reference signs designate like or similar elements.

DETAILED DESCRIPTION

According to a first object, the present invention relates on a solvent transfer printing method for applying a pattern made of a non-soluble material on the surface of an object, said method comprising the following steps:

m1/forming a pattern on a surface of a solvent-soluble substrate, m2/depositing the solvent-soluble substrate on the surface of a solvent bath, on the side of the substrate opposed to the side on which the pattern is applied, in order to dissolve partially the substrate, m3/dipping the object in the bath, so that the surface of the object comes into contact with the pattern, m4/getting the object, on which the pattern is applied, out of the bath, and m5/drying the object.

The solvent transfer printing method according to the invention consists in applying a pattern 1 made of a non-soluble material 10 on the surface of an object 2, whatever the type of the object. Said object can be planar, tri-dimensional, angular or with round angles. The object 2 has for example a complex 3D shape, as a concave or convex shape with corners. It is possibly a soft object as organic like skin, or a curvilinear object as a daily-life object, or a stretchable object as a textile.

In the present description, the terms "applied on" or "wrapped around" will be used indifferently. In case of planar objects, the word "applied on" will be more commonly used, while in case of three-dimensional object, the word "wrapped on" will be more commonly used.

The method according to the invention comprises at least five steps m1)-m5) as illustrated on FIGS. 1*a* to 1*f.*

The first step m1) is for forming a pattern 1 on the surface of a solvent-soluble substrate 3.

The pattern is in a non-soluble and non-dispersible material 10, which is selected in the group consisting of a metal, a semiconductor, an organic material as a cross-linked polymer or a mixture thereof.

The pattern is insoluble and non-dispersible. It is not a liquefiable or dispersible ink.

The different techniques for forming a pattern are selected in the group consisting of a combination of a lithography process with a lift off process; an etching process; a solvent free inkjet printing process, or a combination thereof, depending on the required accuracy. They will be exposed further.

Figure 1A:
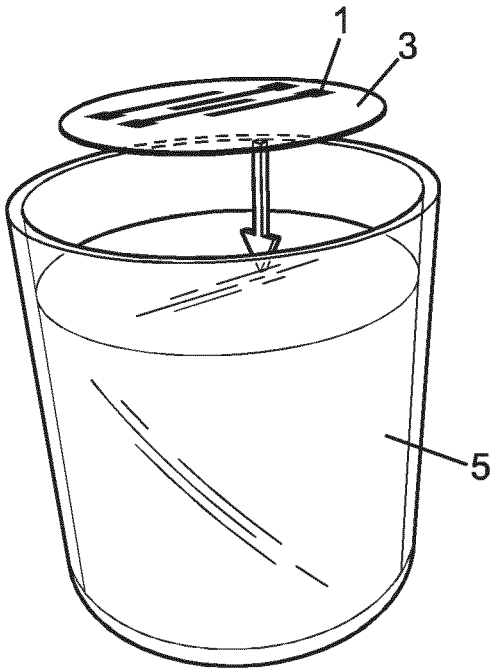
FIGS. 1*a* to 1*f* are schematic representations of the steps m1 to m5 of the method for wrapping the pattern on the object.

The second step m2) consists in depositing the solvent-soluble substrate 3 on the surface of a solvent bath 5 as illustrated on FIG. 1*a*, on the side of the substrate opposed to the side on which the pattern is applied, in order to dissolve at least partially the substrate 3.

The substrate 3 is at least partially immerged in the solvent while the pattern on top of the solvent is not immerged. A particular attention has to be paid to avoid wetting the side of the pattern opposed to the side in contact with the substrate. The substrate 3 is at least partially dissolved, and the pattern, possibly with the substrate left, floats on top of solvent. In case where a thin layer of substrate is left, on the bottom of the pattern it forms a protective shell to protect the pattern side on the substrate side.

Figure 1B:
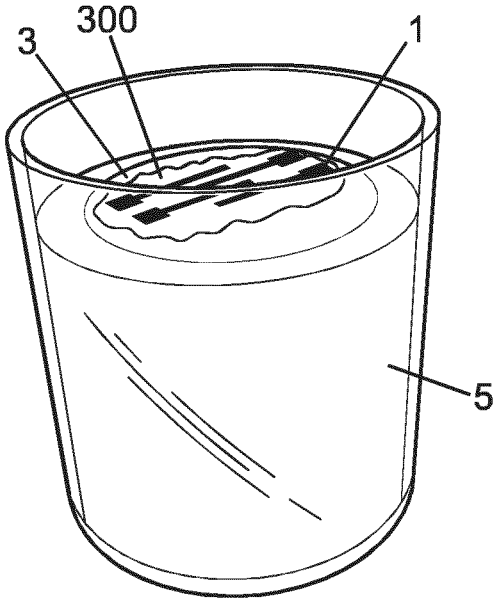

The substrate is partially dissolved and forms a viscous and adhesive paste 300 which surrounds the patterns, as illustrated on FIG. 1*b*. The paste 300 surrounding the pattern protects the pattern side opposed to the partially dissolved substrate from being wet by solvent which could come on top of pattern involuntarily, for example if the solvent bath is shaken.

Figure 1C:
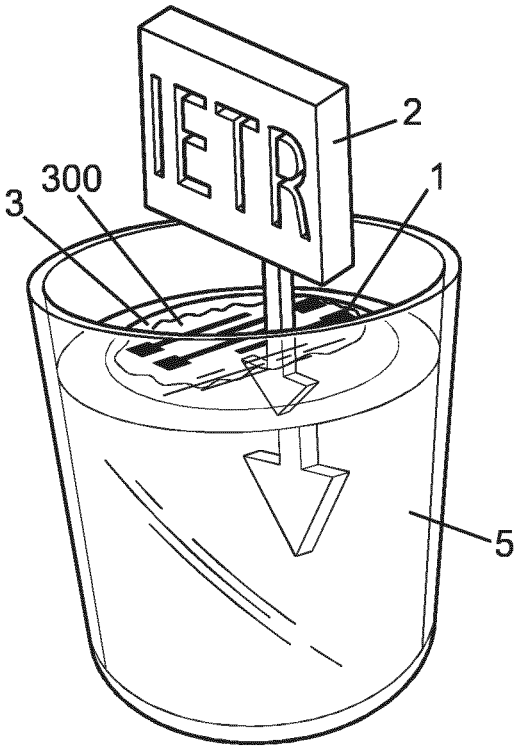
Figure 1D:
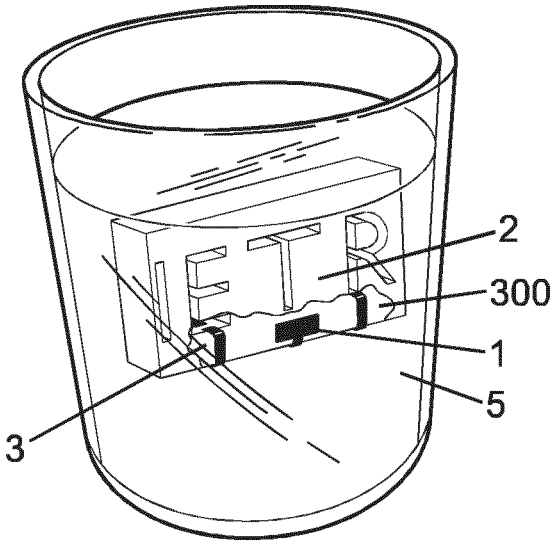

The third step m3/illustrated on FIG. 1*c* consists in dipping the object 2 in the bath 5, so that the surface of the object 2 comes into contact with the pattern 1, on the pattern side opposed to the partially dissolved substrate. The floating pattern is soften when floating at the solvent surface. The object is not immerged in the solvent but approached to the pattern which floats at the surface of the solvent and then brought into contact with the pattern. The paste 300 at this step protects from any solvent to be inserted between the object 2 and the pattern 1 when the object and the pattern are brought into contact, as illustrated on FIG. 1*d*. The pattern 1 sticks on the object 2 on the pattern side opposed to the pattern side covered with the substrate 3. Capillarity forces existing between a small structure and a macroscopic surface allow the adhesive connection. Consequently the pattern 1 is applied on the object 2. The object on which is applied the pattern, sinks then in the solvent, as illustrated on FIG. 1*d*.

Figure 1E:
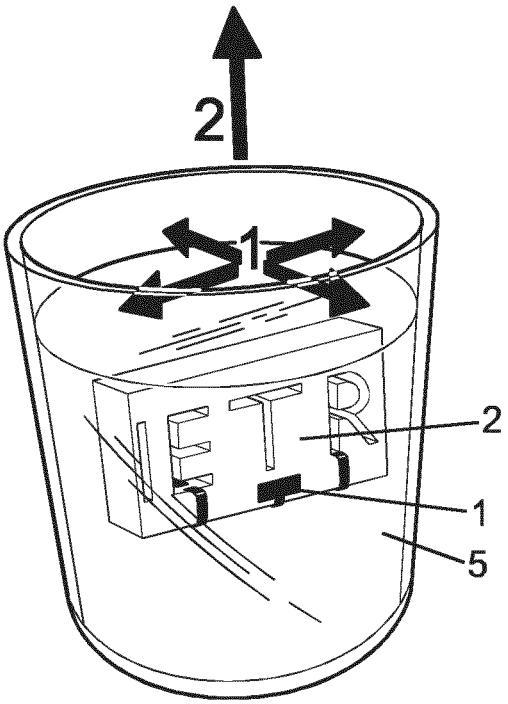
Figure 1F:
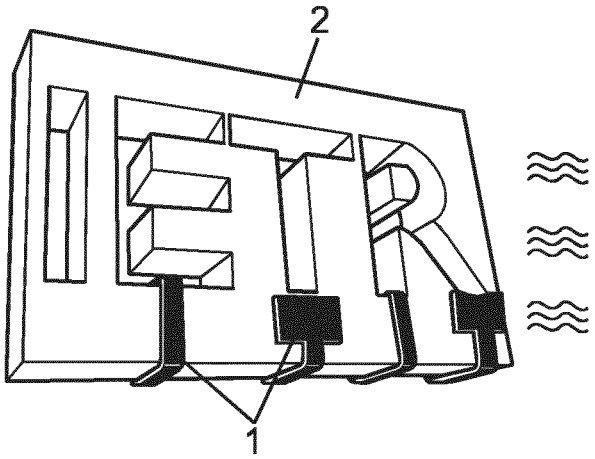

The fourth step m4/illustrated on FIG. 1*e* consists in getting the object 2, on which the pattern 1 is applied, out of the bath 5. In a fifth step m5/as illustrated on FIG. 1*f*, the object 2 on which a pattern is applied on or wrapped over is dried, for example in an oven.

According to a specific embodiment, the solvent transfer printing method according to the invention comprises an additional step m3'/of dissolving the substrate left, said step m3'/being performed just before step m3/or just after step m3/.

This step is important for some applications in particular where the object is for electronic applications.

In order to enhance dissolving the substrate the solvent bath can be heated up between 30° C. and 60° C., in particular during step m3'/.

It is also possible to stir the solvent bath. Thus, according to an embodiment, the solvent bath is stirred, in particular during step m3'/.

If necessary, the solvent bath can be both heated and stirred, to enhance dissolving the substrate.

In particular, when the substrate is made of PVA, the solvent bath 5 is stirred to help dissolving the PVA. The solvent could also be renewed to help dissolving the substrate.

Figure 2A:
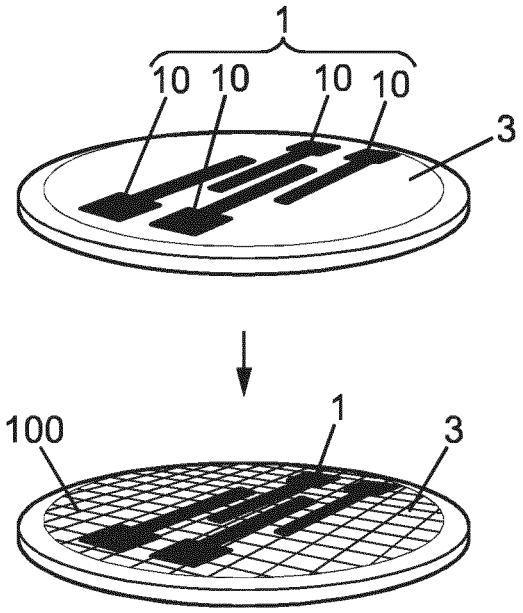
FIGS. 2*a* and 2*b* illustrate the embodiment wherein a mesh layer is formed on top of the pattern in case respectively of applying on a two dimensional and on a three dimensional support.

In case where the pattern consists in independent, i.e. not linked, sub-patterns, sub-patterns may move randomly at the solvent surface, which can be damaging for the final results. To avoid said problems, in an embodiment, as illustrated on FIG. 2*a*, wherein the pattern 1 is composed by a plurality of sub-patterns 10, before step m1/, the method may comprise the formation a mesh layer 100 on top of the sub-patterns, on the side opposed to the side contacting the substrate. The mesh layer 100 is adapted to maintain the sub-patterns 10 of the pattern 1 linked. Thus, when the substrate 3 is dissolved, the sub-patterns 10 keep the same position relatively to each other, the pattern is thus well positioned on the object. Indeed, when in step m3/, the pattern is applied on the object, the mesh is sandwiched between the object and the pattern. The mesh is thin enough to create no relief for the pattern on the object surface. As an alternative the mesh could be formed on the bottom of the pattern meaning between the pattern and the substrate. In this case, when in step m3/, the pattern is applied on the object, the mesh layer 100 is covering the sub-patterns 10 of the pattern 1.

Figure 2B:
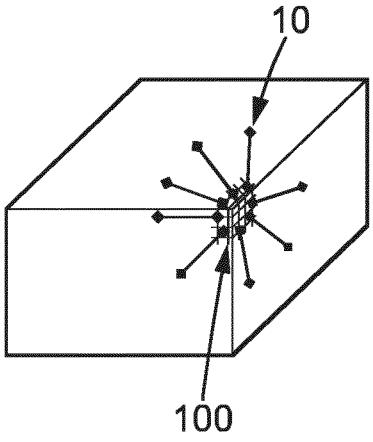

Sub-patterns 10 are submitted to radial forces during substrate 3 dissolution. Consequently, the mesh layer 100 is deposited at a specific location of the pattern 1, in order to keep stretching properties to avoid pleating the pattern for a conformal wrapping. For instance, if sub-patterns 10 are located in star configuration (FIG. 2*b*) the mesh layer is located in the central part of the pattern 1 in order to obtain conformal wrapping without damaging the pattern 1 accuracy.

In another embodiment, the method can further comprise an alignment step wherein the pattern 1 and the object 2 are positioned relative to one another using a camera. This step is useful for the alignment of a pattern on another pattern already wrapped on the object or for the precise location on the object of the pattern to apply. The camera 6 is used to locate precisely the pattern 1 and the object 2 relatively to each other. The camera is for example an equipment integrating virtual simulation, object calibration, and controlled immersion.

Figure 6A:
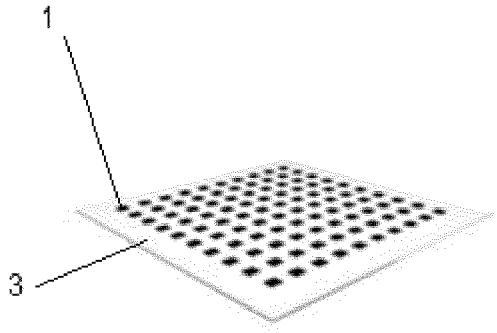
FIGS. 6*a* to 6*c* illustrate the process according to the invention with controlled deformation of the pattern.
Figure 6B:
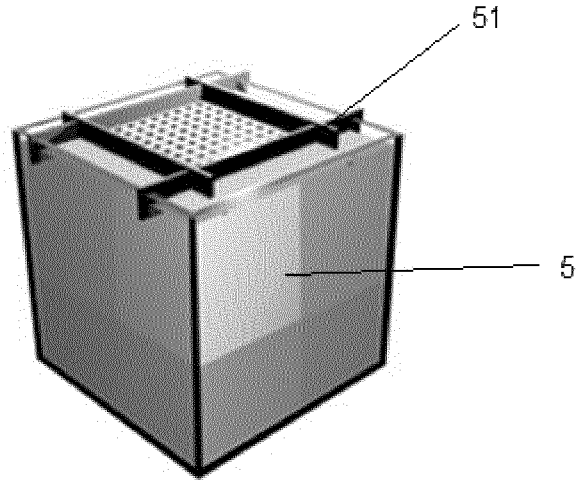

In another embodiment, as illustrated on FIG. 6*b* the solvent-soluble substrate (3) deposited on the surface of the solvent bath (5) is constrained by rigid guides (51) surrounding the substrate (3). Advantageously, the rigid guides (51) surrounding the solvent-soluble substrate (3) are fixed rigid guides. In this case, the fixed rigid guides inhibit the radial spreading of the solvent-soluble substrate without impacting its dissolution mechanism. The pattern is thus immobilized.

Figure 7A:
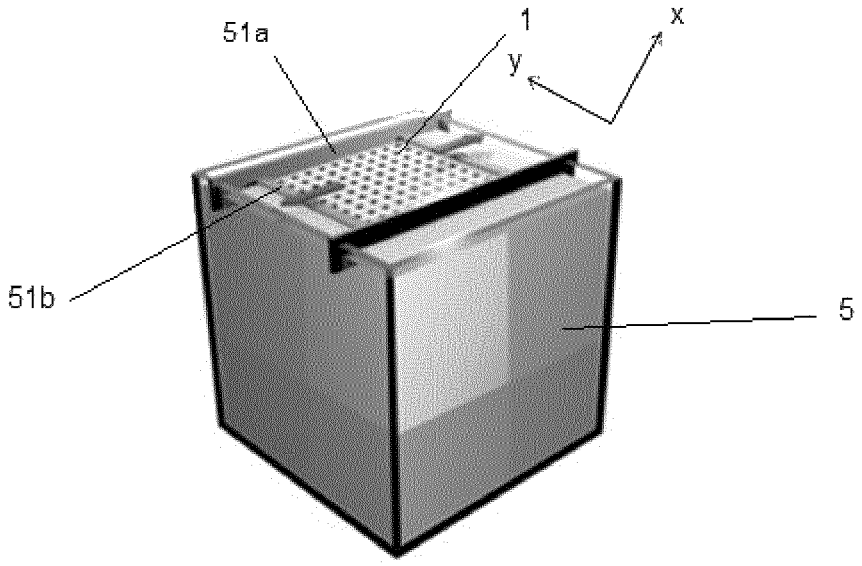
FIGS. 7*a* to 7*b* illustrate the process according to the invention with controlled extension of the pattern.
Figure 7B:
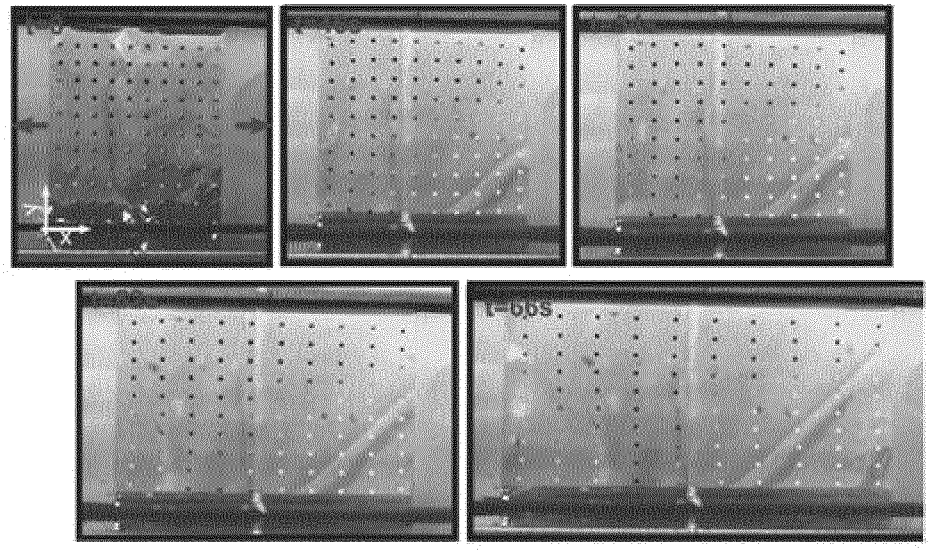

It is also possible to easily stretch the pattern before its transfer in a controlled manner. As illustrated on FIGS. 7 and 8, the substrate is constrained by fixed (51*a*) and sliding rigid guides (51*b*) along x and y axis respectively. Advantageously, the pattern (1) is constrained by fixed (51*a*) and sliding rigid guides (51*b*) along y and x axis respectively. In this case, radial forces are constrained between the fixed rigid guides (51*a*) and act on the sliding rigid guides (51*b*) that slide between the fixed rigid guides (51*a*). The sub-pattern extends thus along the x axis. Advantageously, the sliding rigid guides (51*b*) slide perpendicularly to the fixed rigid guides (51*a*).

Fixed (51*a*) and sliding rigid guides (51*b*) can be placed in any position to control the extension of the pattern.

Thanks to said controlled extension, a small initial soluble substrate on which a pattern is present can allow the deposition of an enlarged pattern on objects of different sizes. The pattern can be enlarged in at least one direction before being applied on the object.

In another embodiment, as illustrated on FIG. 8, the pattern is a meander or horseshoe ribbon which can be easily elongated without tearing or breaking. Elongation up to 200% can be obtained in the direction parallel to the ribbon.

In another embodiment, the pattern is designed in a serpentine, meanders or horseshoe shape along a general extension direction thereby helping to increase the pattern flexibility and to limit the risk of pattern breaking when the pattern is wrapped on a sharp edge of an object.

The solvent is an organic solvent or an aqueous solvent, for example an alcohol or an aqueous solution of alcohol, or water.

According to a specific embodiment, the solvent is water and the water-soluble substrate on which is formed the pattern in step m1/is typically a polyvinyl alcohol (PVA) film, with a thickness between 20 μm and 100 μm.

The pattern is made of a material which is not soluble in the solvent as defined above. Such a material is selected from a metal, a semiconductor, an organic material such as a crosslinked polymer, or a mixture thereof, all of them being non-soluble and non-dispersible materials. The pattern is for example formed by centimeter lines for forming interconnections to micrometer lines for transistor patterns as a transistor drain or a transistor source.

In the embodiment wherein a mesh is formed to maintain the sub-patterns together, the mesh has a thickness ranging from 400 nm to 1 μm typically, avoiding thus any relief problem. The mesh is for example in epoxy resin as SU-8, or alternatively in metal. The mesh layer is for example patterned using lithography or inkjet printed. Alternatively an epoxy based ink with a squared mesh geometry is printed. If necessary, in particular, when the the mesh is in epoxy, it can be easily removed using O2 plasma.

Then, the water soluble substrate is deposited on the surface of the water bath in a step m2/. The substrate floats at the surface of the water bath. The substrate 3 then partially dissolves in typically 1 minute, forming thus a more viscous substance, like a paste 300, at the surface of the bath surrounding the pattern. This "paste" 300 protects the pattern 1. The bath is advantageously heated up between 30° C. and 60° C. in order to enhance the dissolution. It can also be gently stirred.

When the dissolution of the substrate is considered as sufficient, the object on which the pattern will be applied is introduced in the water bath so that the surface of the object contacts the pattern. While the object is dipping into the bath the pattern is wrapped around its surface. The object wrapped is then maintained into water to dissolve the substrate left. The substrate is typically totally dissolved when the object is dipped into the water for at least 15 minutes.

The object on which the pattern is applied is then got out of the bath and dried using warm air in a heat chamber for example.

In another embodiment, the object (2) has a curved surface.

In another embodiment, the object (2) is a pattern of electrodes and connection lines.

In another embodiment, the object (2) has a curved surface and the pattern is a pattern of electrodes and connection lines.

A second object of the invention is a particular method for forming a pattern on a surface of a solvent-soluble substrate by combining a lithography process with a lift off process according to the following steps:

a1/spin coating a photo-sensitive resist stack layer (4) on the solvent soluble substrate (3), a2/insulating the resist stack layer (4) through a mask, a3/developing the resist stack layer (4), with a first product which is solvent free, a4/depositing the pattern material (10) on the resist stack layer (4), a5/removing the resist stack layer (4) with a second product which is also solvent free, in order to obtain the pattern formed on the surface of the solvent-soluble substrate.

Figure 3A:
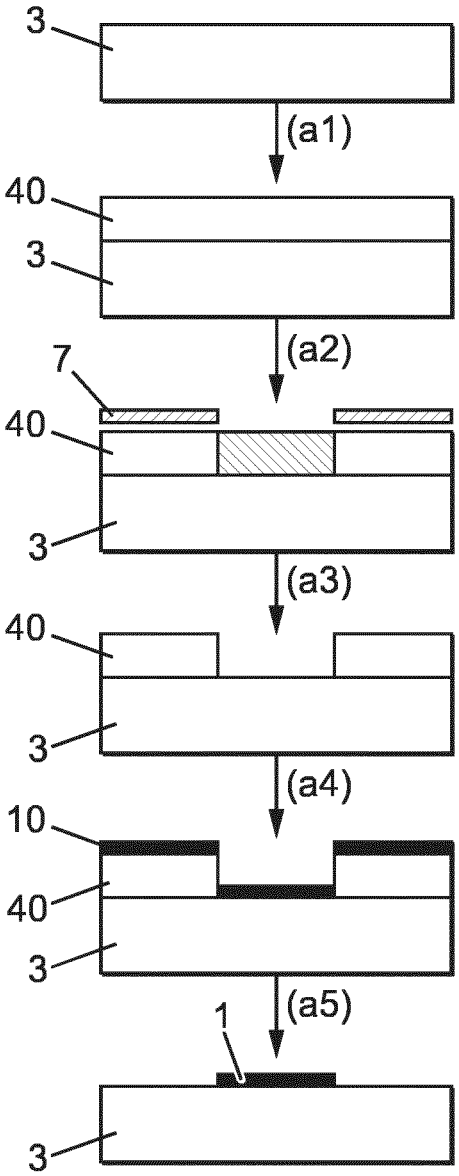
FIGS. 3*a* and 3*b* are schematic illustration of lithography and lift off steps for forming a pattern according to two different embodiments.
Figure 3B:
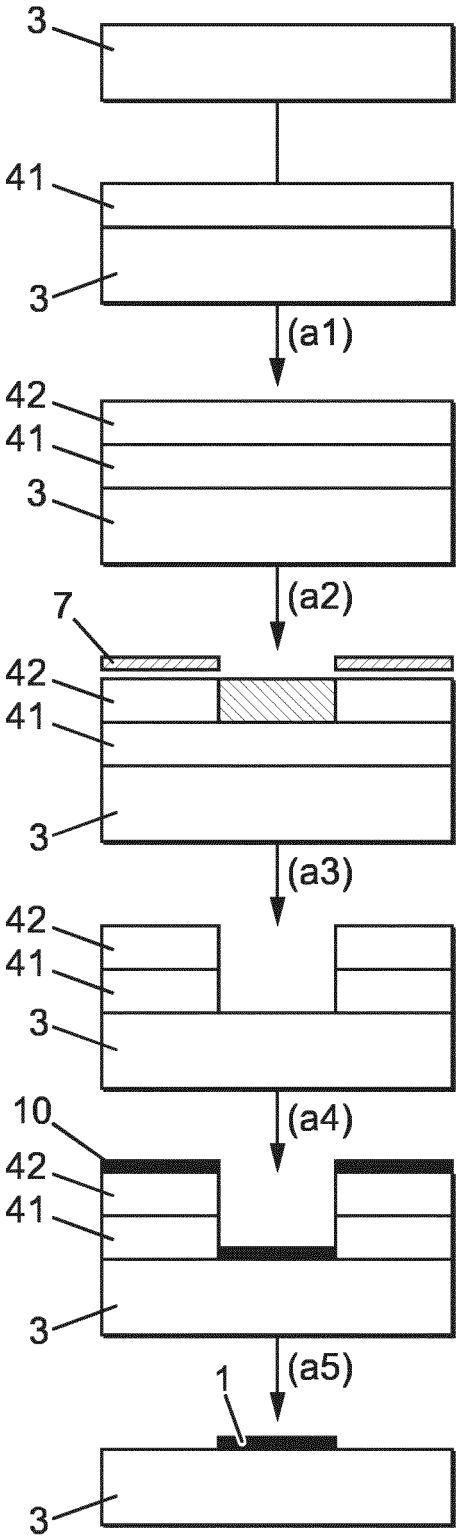
Figure 4:
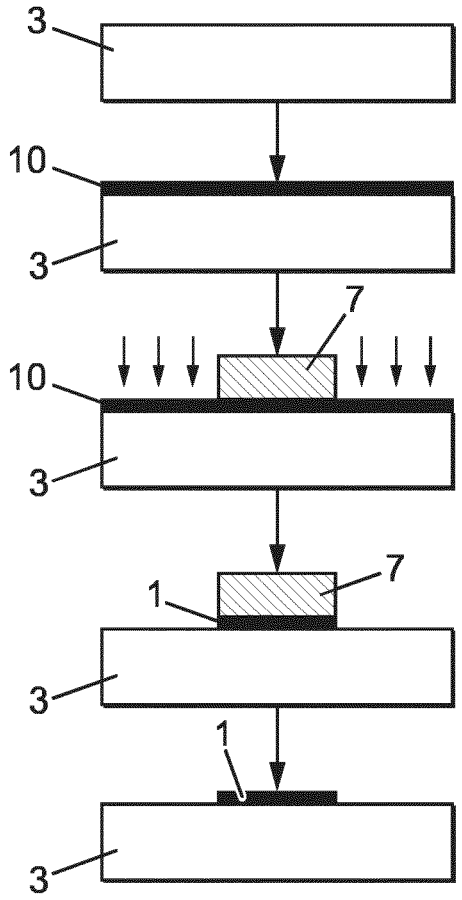
FIG. 4 illustrates the etching process for forming a pattern.

The method for forming a pattern 1 on a surface of a solvent-soluble substrate 3, illustrated on FIGS. 3*a* and 3*b* combines a lithography process with a lift off process, to obtain patterns with a high accuracy for small area patterning.

In a first step a1/of the method, a photo-sensitive resist stack layer 4 is spin coated on the solvent soluble substrate 3.

In a second step a2/the resist stack layer 4 is insulated through a mask 7. The mask 7 is positioned between the resist and the radiation source. The radiation crosses the mask 7 and insulates the resist stack layer through the mask. The insulated resist chemistry is modified by the radiation.

The method comprises a third step a3/of development of the resist stack layer 4 with a first product which is solvent free. The part of the resist which has been insulated is removed (i.e., or crosslinked depending of photoresist nature; positive or negative) by the first product during the development phase. The non-insulated resist is left on top of the substrate after the development step a3/.

The pattern material 10 is deposited on the resist layer 40 in a fourth step a4/. The pattern material is deposited in holes formed wherein resist was removed. The material is also deposited on top of the resist left after development.

In a fifth step a5/the resist stack layer 4 left on the substrate is removed with a second product which is also solvent free. The pattern material covering the resist left is removed when the resist is removed. The pattern material directly deposited on the substrate forms the pattern.

In a first preferred embodiment illustrated on FIG. 3*a*, the stack layer 4 is a single photosensitive resist layer 40. Said photosensitive resist 1 is chosen among photosensitive resists to which are associated a solvent free developer (first product in the general case) and a solvent free remover (second product in the general case). The single photosensitive resist layer 40 spin coated on the substrate is insulated through the mask 7. The insulated layer is developed by the resist developer, i.e. the resist is removed in the zone where the resist was insulated. The pattern material is deposited in the holes formed by the development. The resist layer 40 is then removed by the resist remover. Neither the developer nor the remover which are solvent free would damage the substrate.

In a second preferred embodiment illustrated on FIG. 3*b*, the stack 40 is formed by a resist bi-layer comprising a resist top layer 42 deposited on top of a resist bottom layer 41. The resist top layer is chosen among resists which are associated with a solvent free developer (first product in the general case). The resist bottom layer is chosen among resists which are removable by the said solvent free developer (second product in the general case).

This embodiment is preferred in case wherein an epoxy resist for example, which has no known remover, has to be used for obtaining thin drawings with high accuracy.

The resist top layer 42 is an epoxy based photo-sensitive resist and/or the resist bottom layer 41 is selected from a Microposit®, SPR or AZ1518 photo-sensitive resist.

This second embodiment is also chosen in case of using a resist to which is associated a developer which contains solvent.

In this embodiment, the resist bottom layer 41 is spin coated on the substrate, and then the resist top layer 42 is spin coated on the resist bottom layer 41. The resist stack layer 40 thus formed is insulated through the mask 7. The radiation goes through the top layer 42 and insulates mainly the top layer 42. The insulated stack 40 is then developed by the resist developer. The developer develops, meaning removes, the resist of the top layer 42 in zones wherein the top layer was insulated. The developer then removes the resist bottom layer in zones wherein the resist top layer 42 is already removed. The bottom layer 41 is developed in a way to uncover from resist zones of the substrate vertically straight below zone of the resist stack 40 not covered by the mask 7 during the insulation. The pattern material is deposited in the holes thus formed. The resist stack layer 40 is then removed by the resist developer. The developer used which is solvent free does not damage the substrate.

In a general example, in the second embodiment wherein two resist layers are successively spin coated on the substrate, the bottom spin coated photoresist 41 is for example a Microposit® photosensitive resist as s1818. The bottom resist layer has typically a thickness of about 2 μm. The top layer 42 is typically SU2002 and is spin coated with a thickness of about 1 μm. The resist stack is insulated by a radiation during a time of 90 seconds The resist stack thus insulated is developed in a developer, Su8 developer for about 10 seconds minutes. The developer removes the insulated part of the top layer as well as the part of the bottom layer which is vertically below the removed part of the top layer. The pattern material is deposited typically by vapour deposition. The resist stack layer is then removed using the top resist developer applied for about more than 1 hour, to remove the resists from the substrate.

Patterns with an accuracy of typically 2 μm are thus obtained.

In another embodiment, the second object of the present invention can be used to form the pattern of the first object of the invention.

Another object of the invention is the use of a solvent-soluble substrate with a pattern in the solvent printing method described above.

A last object of the invention is the application of the above methods for reporting electrodes and connection lines on a curved surface in order to form control panels, encapsulated sensors or printed capacitive buttons and sliders. Other examples of applications can be for forming strain gauge sensors on elements placed on the body, such as gloves, to assess a user displacement; is for forming conformal antennas or by using a transparent material as ITO, for transparent electronic on 3D objects, etc.

The present invention will be more clearly understood with reference to the following examples which are given only for illustration purposes.

EXAMPLES

Example 1: Preparing a Pattern on a Water-Soluble Substrate by Lithography

Photoresist as sacrificial layer was spin-coated on glass or silicon wafer. A solution of poly-vinyl alcohol (PVA; Mw 9000-10000, 80% hydrolyzed from Aldrich) was prepared by mixing DI water and PVA's powder (5:1 w/w water: PVA). The 0.4 μm filtered solution of PVA was spin-coated to obtain a 50 μm layer thickness and then baked at 100° C. during 2 hours to dry the film. 100 nm thin layer of Aluminum was deposited by thermal evaporation. Reactive ion etching was used to etch Aluminum. Lift-off process can also be performed using a bi-layer of Su8 2002 and another photoresist (S1818 photoresist, Shipley in this study). 2 μm thick S1818 was spin-coated on PVA and hard baked at 120 during 15 minutes. Then, Su8 2002 was spin coated on S1818 following the datasheet (soft bake, UV dose and hard bake). During the development step, Su8 developer etch S1818 and consequently, a special attention must be paid to guarantee lithographical accuracy of the patterns. Then 500 nm of Su8 2002 is spin-coated and squared mesh geometry is performed. PVA substrate is easily detached from the carrier substrate dissolving sacrificial photoresist using acetone.

An insoluble and non-dispersible pattern of aluminum is thus formed at the surface of the PVA substrate.

Example 2: Preparing a Pattern on a Water-Soluble Substrate by Printing

The printing was performed using CERADROP® X-series printer on a PVA film.

Inks were used without filtering steps. Epoxy based ink (Su8-2000 series; MicroChem, Westborough©, MA, USA) surface tensions and viscosity were 35 $mN \cdot m^{-1}$ and 2.49 cp respectively. Silver nanoparticules (Silverjet DGP 40LT-15C from ANP®) surface tension and viscosity were 35 $mN \cdot m^{-1}$ and 15 cp respectively. Silver ribbons were printed using 256 nozzles Q-class printhead (Dimatix®) and baked on hot plate at 130° C. for 30 min. Then, Epoxy based ink (squared mesh geometry) was printed using a 16 nozzles cartridge (Dimatix®) and baked at 95° C. for 5 min in an oven followed by UV ($\lambda$=365 nm) exposure and baked again in an oven at 95° C. for 5 min. An insoluble and non-dispersible pattern of silver and epoxy resin is thus formed at the surface of the PVA substrate.

Example 3: Dipping and Transfer Steps

PVA films obtained in examples 1 and 2 are each deposited at the surface of water (both: laminated or spin coated). PVA film is dissolved after 15 minutes.

Then, the object is dipped through the floating structure. The object is gently shaked inside the water bath to allow a better dissolution of PVA that remains at it surrounding. At last step object is withdrawn and dried.

Figure 5A:
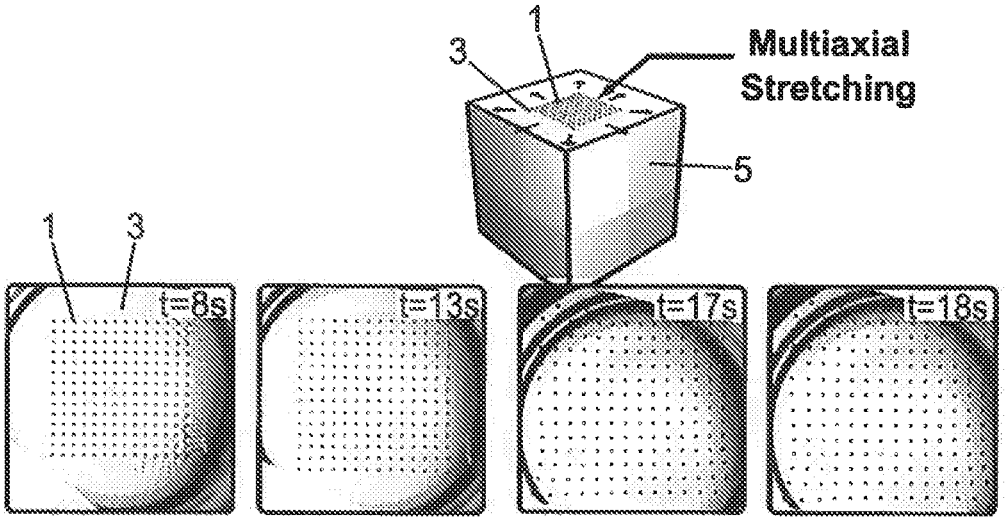
FIGS. 5*a* to 5*c* illustrate step m2 of the process according to the invention.
Figure 5B:
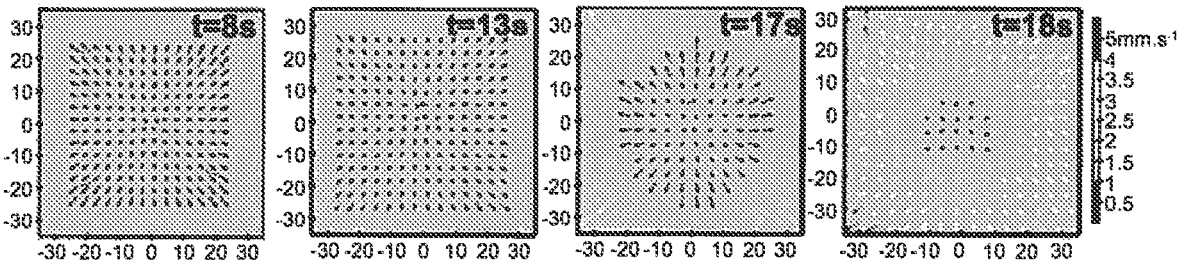

Example 4: PVA Dissolution Mechanism and Applications on Spheres of Different Sizes A 14×14 matrix of 1 mm square shaped 150 nm thick aluminum sub-patterns, spaced from 2 mm have been fabricated onto PVA substrate according to example 1, in order to characterize its dissolution behavior. Said example is illustrated by FIGS. 5*a* to 5*c*.

As shown in the optical pictures (FIG. 5*a*) and illustrated in the 3D scheme (FIG. 5*b*), radial forces occur during the PVA dissolution step m2. Indeed, top view images clearly show that the aluminum sub-patterns separate from each other as function of time (FIG. 1*a*). The FIG. 5*b* shows vector maps of the sub-patterns displacement and velocity as function of time. The four graphics show data (i.e. displacement and velocity) after 8, from 8 to 13, from 13 to 17 and from 17 to 18 seconds, respectively. Independently of time, displacement and velocity are higher at the periphery of the matrix. Moreover, all the sub-patterns movements are preferentially orientated from the center to the edge of the matrix confirming that radial forces occur during the PVA dissolution.

Figure 5C:
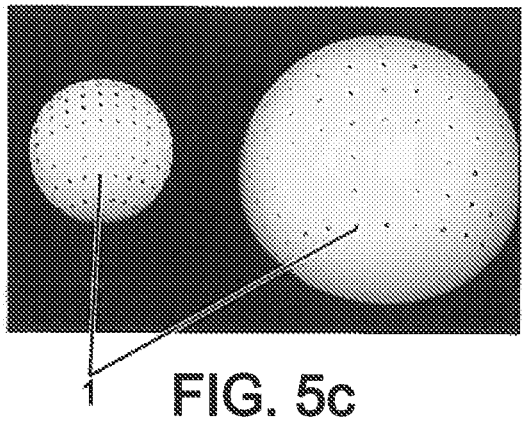

This property was used to transfer the same initial pattern (14×14 matrix of 1 mm square shaped 150 nm thick aluminum sub-patterns, spaced from 2 mm) onto a table tennis ball (diameter=38 mm) (FIG. 5*c* left hand) and onto an hemispherical nylon based ball (diameter=80 mm) (FIG. 5*c* right hand). The transfer was made immediately after introduction of the film on the solvent for the tennis ball and after 80 s for the Nylon ball. On the tennis ball, sub-patterns were spaced from 3 mm while on the Nylon ball they were spaced from 9 mm.

Photos of the obtained products are given on FIG. 5*c*.

Example 5: Pattern Immobilization

A 14×14 matrix of 1 mm square shaped 150 nm thick aluminum sub-patterns, spaced from 2 mm have been fabricated onto PVA substrate according to example 1 (see FIG. 6*a*).

Figure 6C:
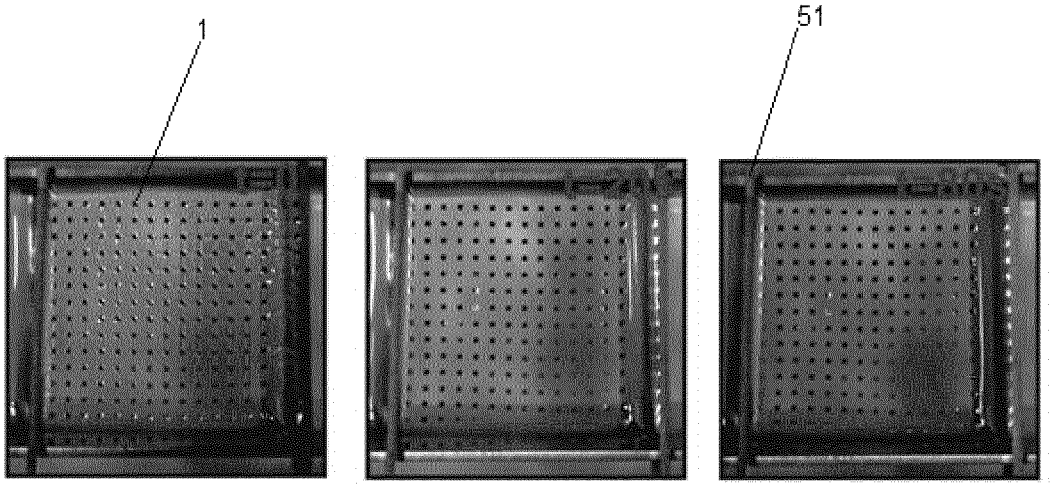

On the surface of the water bath used to perform steps m2 and m3 of the process according to the invention, fixed rigid guides were installed (see FIG. 6*b*) to delimit a surface corresponding to the surface of the PVA substrate. Then the substrate was placed on the surface of water inside the space delimited by the fixed rigid guides (51). The sub-patterns were observed during the dissolution of the PVA substrate. Photos at t=0, 20 and 80 seconds. Results are given on FIG. 6*c*.

The fixed rigid guides allow an immobilization of the sub-pattern and thus a control of the size of the pattern to be transferred.

Example 6: Pattern Elongation

A 14×14 matrix of 1 mm square shaped 150 nm thick aluminum sub-patterns, spaced from 2 mm have been fabricated onto PVA substrate according to example 1.

On the surface of the water bath used to performed steps m2 and m3 of the process according to the invention, four rigid guides 51*a*, 51*b* were installed (see FIG. 7*a*) to delimit a surface corresponding to the surface of the PVA substrate. Two of the guides 51*a* were fixed and parallel, the two other guides 51*b*, perpendicular to the fixed guides 51*a*, were sliding rigid guides 51*b* able to slide along the axis of the fixed guides.

The substrate was placed on the surface of water inside the space delimited by the rigid guides.

The sub-patterns were observed during the dissolution of the PVA substrate. Photos at t=0, 46, 54, 62, 66 seconds are given on FIG. 7*b*.

The rigid guides allow a controlled elongation along the x axis.

Example 7: Elongated Electric Connections

Figure 8A:
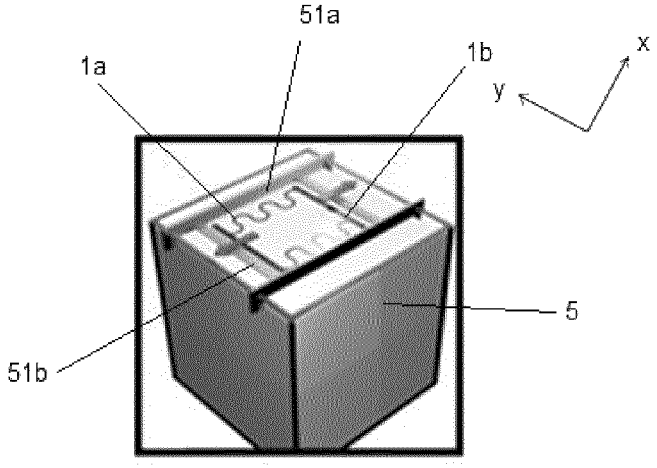
FIGS. 8*a* to 8*c* illustrate the process according to the invention with controlled extension of the pattern wherein the pattern is a meander or horseshoe ribbon.
Figure 8B:
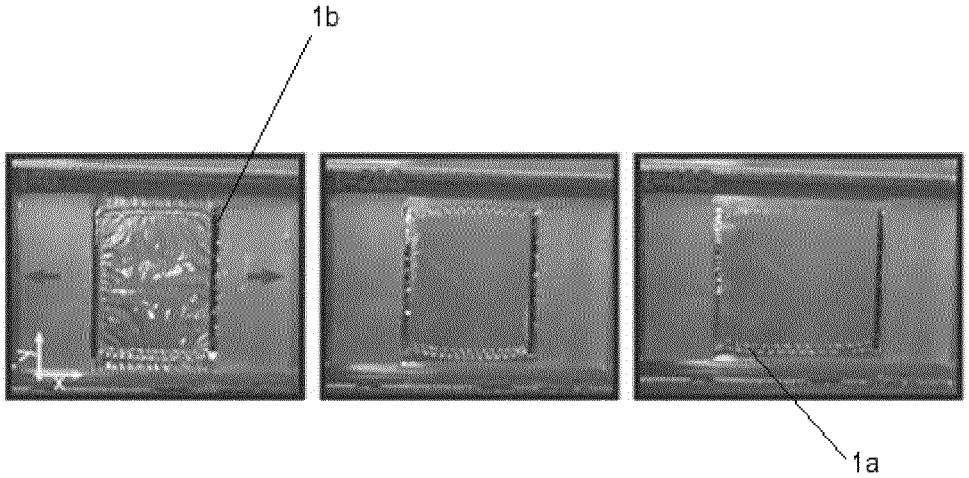
Figure 8C:
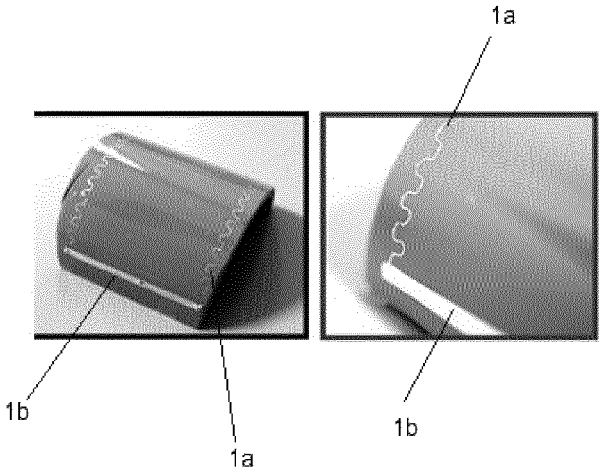

On a 15×15 cm PVA film, an aluminum pattern (width: 150 nm) was applied by thermal vaporization, said pattern consisting of two parallel horseshoe ribbons 1*a* connected to 2 parallel straight lines 1*b* placed near the square sides (see FIG. 8*a*).

On the surface of the water bath used to performed steps m2 and m3 of the process according to the invention, four rigid guides 51*a*, 51*b* were installed (see FIG. 8*a*) to delimit a surface corresponding to the surface of the PVA substrate. Two of the guides 51*a* were fixed and parallel, the two other guides 51*b*, perpendicular to the fixed guides 51*a*, were sliding rigid guides 51*b* able to slide along the axis of the fixed guides.

Then the substrate was placed on the surface of water inside the space delimited by the four rigid guides.

The patters was observed during the dissolution of the PVA substrate. Photos at t=0, 20 and 46 seconds are given on FIG. 8*b* (same scale).

After 46 seconds, a hemi-cylindrical object was dipped in the water bath so that its surface comes into contact with the pattern and then was withdrawn from the bath and dried. Pictures of the obtained product are given in FIGS. 8*c* and 8*d*.

The rigid guides allow a controlled elongation along the x axis.

The invention claimed is:

1. A solvent transfer printing method for applying a pattern made of a non-soluble and non-dispersible material on the surface of an object, the method comprising the following steps:

m1/forming a pattern made of a non-soluble and non-dispersible material, which is not a liquefiable or dispersible ink, on a surface of a solvent-soluble substrate, m2/depositing the solvent-soluble substrate on the surface of a solvent bath, on the side of the substrate opposed to the side on which the pattern is applied, in order to dissolve partially the substrate, m3/dipping the object in the bath, so that the surface of the object comes into contact with the pattern, m4/getting the object, on which the pattern is applied, out of the bath, m5/drying the object, the non-soluble and non-dispersible material being selected from the group consisting of a metal, a semiconductor, a cross-linked polymer, and a mixture thereof.

2. The solvent transfer printing method according to claim 1, comprising an additional step m3'/of dissolving the substrate left, said step m3'/being performed just before step m3/or just after step m3/.

3. The solvent transfer printing method according to claim 1, wherein the solvent is water.

4. The solvent transfer printing method according to claim 2, wherein in step m3') the solvent bath is heated up.

5. The solvent transfer printing method according to claim 2, wherein in step m3') the solvent bath is stirred.

6. The solvent transfer printing method according to claim 1, wherein the step m1) of forming the pattern on the solvent soluble substrate is selected in the group consisting of a combination of a lithography process with a lift off process; an etching process; a solvent free inkjet printing process, or a combination thereof.

7. The solvent transfer printing method according to claim 1, wherein the pattern is composed by a plurality of sub-patterns, which are maintained together with a mesh layer deposited in contact with the pattern.

8. The solvent transfer printing method according to claim 7, wherein the mesh layer is deposited in a central part of the pattern.

9. The solvent transfer printing method according to claim 1, further comprising an alignment step wherein the pattern and the object are positioned relative to one another using a camera.

10. The solvent transfer printing method according to claim 1, wherein the step m1 combines a lithography process with a lift off process, according to the following steps:

a1/coating a photo-sensitive resist stack layer on the solvent soluble substrate, a2/irradiating the resist stack layer through a mask, a3/developing the resist stack layer, with a first product which is solvent free, a4/depositing the pattern material on the resist stack layer, a5/removing the resist stack-layer with a second product which is also solvent free, in order to obtain the pattern formed.

11. The solvent transfer printing method according to claim 10, wherein the stack layer is a single photosensitive resist layer selected among photosensitive resists which are associated with a solvent free developer and a solvent free remover, the solvent free developer being used as the first product and the solvent free remover being used as the second product.

12. The solvent transfer printing method according to claim 10, wherein the stack is formed by a resist bi-layer comprising a resist top layer on top of a resist bottom layer, which is removable by the solvent free developer associated to the resist top layer, the first and the second product being a unique product which is the top layer developer.

13. The solvent transfer printing method according to claim 12, wherein the resist top layer is an epoxy based photo-sensitive resist and/or the resist bottom layer is a Microposit® photo-sensitive resist.

* * * * *